US010179393B2

(12) United States Patent
Hull et al.

(10) Patent No.: US 10,179,393 B2
(45) Date of Patent: Jan. 15, 2019

(54) CLAMPING DEVICE

(71) Applicant: Carr Lane Manufacturing Co., St. Louis, MO (US)

(72) Inventors: Aaron Hull, Cottage Hills, IL (US); Colin Frost, St. Louis, MO (US); Joshua Herschbach, Troy, IL (US)

(73) Assignee: Carr Lane Manufacturing Co., St. Louis, MO (US)

( * ) Notice: Subject to any disclaimer, the term of this patent is extended or adjusted under 35 U.S.C. 154(b) by 105 days.

(21) Appl. No.: 15/241,743

(22) Filed: Aug. 19, 2016

(65) Prior Publication Data

US 2017/0050295 A1 Feb. 23, 2017

Related U.S. Application Data

(60) Provisional application No. 62/207,196, filed on Aug. 19, 2015.

(51) Int. Cl.

| | |
|---|---|
| ***B25B 5/10*** | (2006.01) |
| ***B25B 1/24*** | (2006.01) |
| ***B25B 1/02*** | (2006.01) |
| ***B25B 1/08*** | (2006.01) |
| ***B25B 5/02*** | (2006.01) |

(52) U.S. Cl.

CPC ..... *B25B 5/10* (2013.01); *B25B 1/02* (2013.01); *B25B 1/08* (2013.01); *B25B 1/2405* (2013.01); *B25B 5/02* (2013.01)

(58) Field of Classification Search

CPC . B23Q 3/06; B23Q 3/02; B23Q 3/061; B23Q 3/062; B23Q 3/064; B23Q 3/066; B25B 1/24–1/2494

See application file for complete search history.

(56) References Cited

U.S. PATENT DOCUMENTS 2,625,861 A * 1/1953 Swanson ..... B23Q 3/06 24/523
3,223,405 A * 12/1965 Wilson ..... B25B 1/2473 269/137
3,393,633 A * 7/1968 Hoffman ..... B65B 13/022 100/2
3,506,253 A * 4/1970 Swenson ..... B23Q 3/06 269/137
4,063,585 A * 12/1977 Stanley ..... A47G 5/00 16/366
4,237,756 A * 12/1980 Maclay ..... B25B 13/10 81/125.1
4,251,066 A * 2/1981 Bowling ..... B25B 1/2452 269/283
4,335,490 A * 6/1982 Teachout ..... B65B 13/022 24/114.5
4,437,654 A * 3/1984 Chiappetti ..... B25B 1/103 269/283
4,805,888 A * 2/1989 Bishop ..... B23Q 1/5468 269/235

(Continued)

*Primary Examiner* — Tyrone V Hall, Jr.
(74) *Attorney, Agent, or Firm* — Lewis Rice LLC

(57) ABSTRACT

Device and methods comprising a clamping device or vise which applies stabilizing force to a workpiece for a machining, operation using an adjustable stock engagement point, the stock engagement point being adjustable by inserting shims or spacers between the stock engagement surface (e.g., a gripper wall and the body of the device).

8 Claims, 3 Drawing Sheets

(56) References Cited

U.S. PATENT DOCUMENTS

| | | | | | |
|---|---|---|---|---|---|
| 4,915,367 | A * | 4/1990 | Carossino | B25B 1/08 | 269/101 |
| 5,226,637 | A * | 7/1993 | Kitaura | B25B 5/08 | 269/234 |
| 5,244,194 | A * | 9/1993 | Nishimura | B25B 1/2452 | 269/155 |
| 5,624,106 | A | 4/1997 | Weber | | |
| 6,126,158 | A * | 10/2000 | Engibarov | B25B 5/08 | 269/101 |
| 6,289,773 | B1 * | 9/2001 | Patry | B25B 13/08 | 7/138 |
| 9,393,656 | B1 * | 7/2016 | Weber | B23Q 3/103 | |
| 2004/0250528 | A1 * | 12/2004 | Coleman | B25B 27/0071 | 59/84 |
| 2009/0184449 | A1 * | 7/2009 | Drees | B25B 1/22 | 269/71 |
| 2015/0336241 | A1 * | 11/2015 | Engibarov | B25B 1/2405 | 269/281 |

* cited by examiner

CLAMPING DEVICE

CROSS-REFERENCE TO RELATED APPLICATIONS

This application claims benefit of U.S. Provisional Patent Application No. 62/207,196, filed Aug. 19, 2015, the entire disclosure of which is herein incorporated by reference.

BACKGROUND

1. Field of the Invention

The invention relates to the field of machine tools and more particularly to devices for holding workpieces in place during machining operations.

2. Description of the Related Art

Many machining operations require a workpiece to be held in a stationary position. Various types of clamps and vises are used for this purpose. Prior clamping devices used laterally-applied forces to hold the workpiece in place so that, when the force of a machining tool (e.g., a cutting edge or polishing surface) is applied to the workpiece, the workpiece does not move, as the machining tool force is counteracted by an opposite stabilizing force applied by the clamping device. This holds the piece in place; however, when the machining operation is finished and the force of the tool surface is removed from the workpiece, the workpiece can jump or pop out of the clamp. This has been overcome in the prior art with devices having a gripping member which engages the workpiece vertically as well, and thereby providing a force to stabilize the workpiece when the cutting surface is removed.

An example of such a device is described in U.S. Pat. No. 5,624,106 ("'106 Patent"), filed Nov. 13, 1995, and issued as a United States patent on Apr. 29, 1997, the entire disclosure of which is incorporated herein by reference. FIG. 1 depicts a prior art gripping device A according to the '106 Patent for holding a workpiece in position. The depicted gripping device A includes a fixture 2 having a working surface 4 and at least one hole 6; a stop 8 rising above working surface 4 of fixture 2; a fastener 10 and a gripping member 12. Gripping member 12 has a through bore 14 for receiving fastener 10 and a gripper wall 16 adapted to engage the workpiece. When fastener 10 is secured to hole 6 of fixture 2, either by being received in a threaded hole 6 or a threaded nut (not shown) on the reverse side of fixture 2, gripping member 12 slides toward stop 8 and gripper wall 16 applies a downward inward holding force on the workpiece. This holding force begins where the workpiece abuts gripper wall 16 and arcs downward through the workpiece to working surface 4 of fixture 2, thereby pushing the workpiece in towards stop 8 and down against working surface 4. The downward inward holding force can be created by a draft angle formed on gripper wall 16, or through other techniques described in the '106 Patent.

However, using such a device requires that the fastener be inserted into the fixture at an appropriate distance from the workpiece such that the gripper wall will engage the stock (or workpiece) when the fastener is secured to the fixture. The terms "stock" and "workpiece" are used herein interchangeably to refer to the material(s) held in place by the device. Failure to engage the stock in this manner may require resetting the machining operation, resulting in lost time and efficiency.

SUMMARY

Because of these and other problems in the art, described herein, among other things, is a clamping device with a variable, adjustable stock engagement point, and methods of holding a workpiece in place using an adjustable stock engagement point. Generally speaking, and at a high level of abstraction, the device and methods described herein include a clamping device or vise which applies stabilizing force to a workpiece for a machining operation using an adjustable stock engagement point, the stock engagement point being adjustable by inserting shims or spacers between the stock engagement surface (e.g., a gripper wall 16) and the body of the device.

Described herein, among other things, is a clamp comprising: a main body comprising an attachment surface having at least one main body bore therein sized and shaped to accept a fastener; a gripping member comprising an exterior surface and an opposing interior surface having at least one gripping member bore therethrough sized and shaped to receive the fastener and disposed such that, when the gripping member is assembled with the main body, the at least one gripping member bore is generally coaxial with the at least one main body bore; at least one spacer having at least one spacer bore therethrough sized and shaped to receive the fastener and disposed such that, when the gripping member is assembled with the main body and the at least one spacer is disposed therebetween, the at least one spacer bore, the at least one gripping member bore, and the at least one main body bore are generally coaxial.

In an embodiment, the height and width of the attachment surface is generally equal to the height and width of the gripping member.

In another embodiment, the first fastener is threaded and the main body bore is threaded, and the threading is configured such that the threaded main body bore can receive the threaded first fastener.

In another embodiment, the height and width of the at least one spacer is generally equal to the height and width of the gripping member.

In another embodiment, the number of bores is two.

In another embodiment, the at least one spacer comprises a plurality of spacers.

Also described herein, among other things, is a clamp comprising: a main body generally in the configuration of a rectangular prism and comprising: a top and an opposing bottom with a main body bore extending therethrough and sized and shaped to accept a first fastener; an attachment side adjacent and generally perpendicular to the top and the bottom side having disposed thereon a number of bore holes, each bore hole in the number of bore holes being sized and shaped to accept a second fastener; a gripping member generally in the configuration of a rectangular prism and comprising: an exterior stock engagement surface and an opposing interior surface; a number of through bores equal to the number of bore holes in the attachment side, each one of the through bores being disposed through the gripping member such that the each one of the through bores is generally coaxial with a bore hole in the attachment side, and each one of the through bores being sized and shaped to accept the second fastener; at least one spacer generally in the configuration of a rectangular prism and having a number of spacer through bores equal to the number of bore holes in the attachment side, each one of the spacer through bores being disposed through the at least one spacer such that the each one of the spacer through bores is generally coaxial with a bore hole in the number of bore holes in the attachment side, and each one of the spacer through bores being sized and shaped to accept the second fastener.

In an embodiment, the height and width of the attachment side is generally equal to the height and width of the gripping member.

In another embodiment, the first fastener is threaded and the main body bore is threaded, and the threading is configured such that the threaded main body bore can receive the threaded first fastener.

In another embodiment, the height and width of the at least one spacer is generally equal to the height and width of the gripping member.

In another embodiment, the number of bore holes is two.

In another embodiment, the at least one spacer comprises a plurality of spacers.

Also described herein, among other things, is a clamp comprising: a main body generally in the configuration of a rectangular prism and comprising: a top and an opposing bottom with a main body bore extending therethrough and sized and shaped to accept a first fastener; an attachment side adjacent and generally perpendicular to the top and the bottom side having disposed thereon a number of bore holes, and a back side opposing the attachment side, the back side having a recessed channel sized and shaped to accommodate an O-ring; a first lateral side extending between the attachment side and the back side and an opposing second lateral side, the first lateral side and the second lateral side each having a recessed channel sized and shaped to accommodate the O-ring and disposed on the first lateral side and the second lateral side continuously with the back side channel; a gripping member generally in the configuration of a rectangular prism and comprising: an exterior stock engagement surface having a recessed channel sized and shaped to accommodate the O-ring; an interior surface opposing the exterior stock engagement surface and having disposed generally perpendicularly thereon a number of attachment pegs equal to the number of bore holes in the attachment side, each one of the attachment pegs being disposed on the gripping member such that the each one of the attachment pegs is generally coaxial with a corresponding bore hole in the attachment side, and each one of the attachment pegs is sized and shaped to be received by the corresponding bore hole; a plurality of opposing lateral sides extending between the exterior stock engagement surface and the interior surface, each of the opposing lateral sides having a recessed channel sized and shaped to accommodate the O-ring, and disposed continuously with the stock engagement surface channel; at least one spacer generally in the configuration of a rectangular prism and having disposed therethrough a number of spacer through bores equal to the number of bore holes in the attachment side, each one of the spacer through bores being disposed through the at least one spacer such that the each one of the spacer through bores is generally coaxial with a corresponding bore hole in the attachment side, and each one of the spacer through bores being sized and shaped to accept a corresponding attachment peg; and wherein when the gripping member is assembled with the main body, the channels form a single contiguous channel sized and shaped to receive the O-ring and circumscribing the assembly.

In an embodiment, the height and width of the attachment side is generally equal to the height and width of the gripping member.

In another embodiment, the height and width of the at least one spacer is generally equal to the height and width of the gripping member.

In another embodiment, the number of bore holes is two.

In another embodiment, the at least one spacer comprises a plurality of spacers.

In another embodiment, the clamp further comprises the O-ring, wherein the O-ring comprises an elastic material and has an unexpanded circumference less than the circumference of the single contiguous channel.

In a further embodiment, the O-ring is generally in the shape of a quadrilateral.

In a further embodiment, the O-ring is generally in the shape of a square.

DESCRIPTION OF THE PREFERRED EMBODIMENT(S)

The following detailed description and disclosure illustrates by way of example and not by way of limitation. This description will clearly enable one skilled in the art to make and use the disclosed systems and methods, and describes several embodiments, adaptations, variations, alternatives and uses of the disclosed systems and methods. As various changes could be made in the above constructions without departing from the scope of the disclosures, it is intended, that all matter contained in the description or shown in the accompanying drawings shall be interpreted as illustrative and not in a limiting sense.

This disclosure is directed towards a clamping device with a variable, adjustable stock engagement point, and methods of holding a workpiece in place using an adjustable stock engagement point. Generally speaking, and at a high level of abstraction, the device and methods described herein include a clamping device or vise which applies stabilizing force to a workpiece for a machining operation using an adjustable stock engagement point, the stock engagement point being adjustable by inserting shims or spacers between the stock engagement surface (e.g., a gripper wall 16) and the body of the device.

Figure 1:
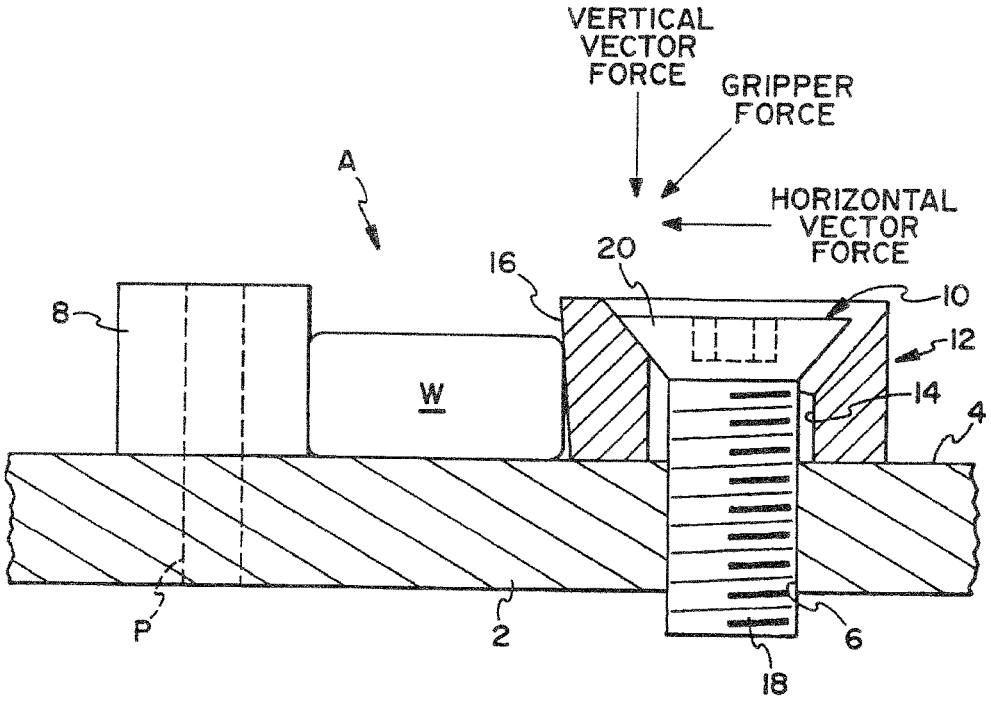
FIG. 1 (PRIOR ART)
FIG. 1 is a side view, partially in cross-section, of a prior art gripping device for holding a workpiece.
Figure 2:
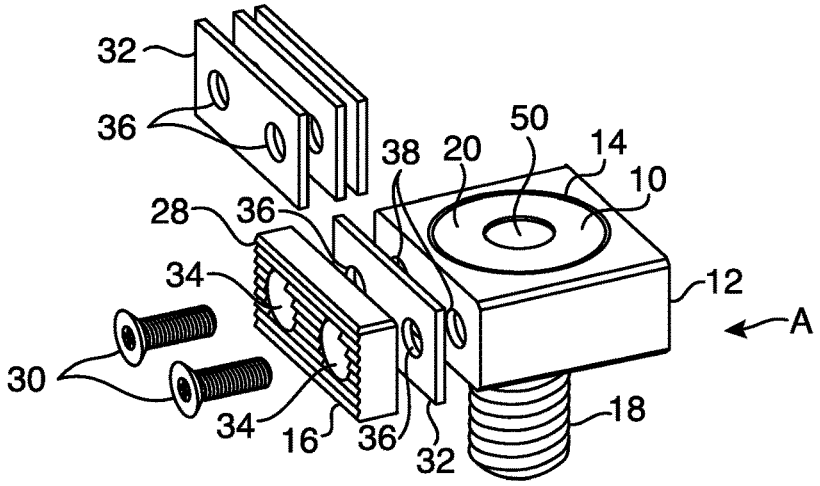
FIG. 2 is an exploded view of an embodiment of a gripping device having an adjustable stock engagement point.

FIG. 2 depicts an exploded view of an embodiment of a clamping device having a variable stock engagement point. In the depicted embodiment, clamping device A comprises a main body 12, a separate gripping member 28 (sometimes referred to as a "face"), and one or more spacers or shims 32. Depicted main body 12 is generally in the configuration of a rectangular prism, and comprises one or more bore holes 38 on an attaching side, sized and shaped for accepting and accommodating one or more fasteners 30. Bore holes 38 may be threaded or unthreaded, depending on the type of fastener 30 used, but will generally be threaded and sized and shaped to receive a threaded fastener 30, which holds spacer 32 and gripping member 28 in place, facilitating minute adjustments to the stock engagement point, as described elsewhere herein. Depicted body 12 also generally comprises a through bore 14 sized and shaped to receive another fastener 10.

Depicted fastener 10 comprises a fastener head 20 rigidly attached to a generally threaded shaft 18, and having an tool engagement point 50 sized and shaped to removably but fixedly couple to a tightening tool (not depicted) to operate the device. By way of example and not limitation, tool engagement point 50 may be a hexagonal recess sized and shaped to receive a standard hex key or Allen key, a standard or Phillips screwdriver, or a protrusion (not depicted) to be received by a socket wrench. Depicted main body 12 is generally in the configuration of a rectangular prism, but in alternative embodiments, other configurations are possible and may be preferable depending upon the nature of the particular application for which it will be used.

The depicted stock engagement point of FIG. 2, also sometimes referred to as the "gripping wall," is an exterior stock engagement surface 16 of separate gripping member 28. Although it could be integral to main body 12, gripping member 28 is depicted as a physically separate or separable element, so that its position may be adjustable with respect to main body 12, as main body 12 is generally attached to a fixture to inhibit movement of the assembly during machining. Stock engagement surface 16 is thus adjusted to accommodate the workpiece by affixing gripping member 28 to main body 12 at a user-determined distance from main body 12.

Gripping member 28 is depicted in the configuration of a rectangular prism, but it is specifically contemplated that, in alternative embodiments, other configurations recognizable by one of ordinary skill in the art are possible and may be preferable depending upon the nature of the particular application for which gripping member 28 will be used.

Depicted gripping member 28 comprises a gripping wall 16 (or, more generally, stock engagement surface 16), which engages the workpiece and applies lateral and vertical forces to hold the workpiece in place. The depicted stock engagement surface 16 has a serrated edge to improve engagement, but it is specifically contemplated that alternative surface textures and finishes may be used, including without limitation, a smooth edge. Gripping member 28, as depicted in FIG. 2, further comprises one or more through bores 34.

Gripping member through bores 34 are generally from the exterior stock engagement surface 16 of gripping member 28, to an opposing interior surface of gripping member 28, and are generally sized and shaped to accommodate fastener 30, and disposed on gripping member 28 such that, when gripping member 28 is attached to main body 12, gripping member 28 bore holes 34 generally align to and are coaxial with main body 12 bore holes 38, allowing fastener 30 to be inserted through gripping member 28 bore holes 34 and into main body 12 bore holes 38 to secure gripping member 28 to main body 12. Gripping member 28 bore holes 34 generally comprise a countersink, sized and shaped to accommodate the head of fastener 30, allowing fastener 30 to recess into gripping member 28 so that fastener 30 does not interfere with the stock engagement between gripping wall 16 and the workpiece.

While the depicted gripping member 28 is generally sized and shaped to have generally the same height and width dimensions as the side of main body 12 to which gripping member 28 is attached, in an alternative embodiment, gripping member 28 may have a different configuration, in which the height and width dimensions of gripping member 28 vary compared to the attaching side of main body 12.

The depicted embodiment further comprises one or more spacers 32 or shims 32. Spacers 32 are generally in the configuration of a thin rectangular prism, and sized and shaped to be placed between gripping member 28 and main body 12 when gripping member 28 is attached to main body 12. Spacers 32 generally comprise one or more through bore holes 36 sized and shaped to receive fastener 30, and disposed on spacers 32 such that, when gripping member 28 is attached to main body 12 and one or more spacers 32 are disposed between gripping member 28 and main body 12, spacer 32 bore holes 38 generally align to and are coaxial with main body 12 bore holes 38 and gripping member 28 bore holes 34, allowing fastener 30 to be inserted through gripping member bore holes 34, spacer 32 bore holes 36, and into main body 12 bore holes 38 to secure gripping member 28 to main body 12 and to secure spacers 32 between gripping member 28 and main body 12. Spacer 32 bore holes 36 may be threaded or unthreaded.

While the depicted spacers 32 are generally sized and shaped to have generally the same height and width dimensions as the side of main body 12 and of gripping member 28, in an alternative embodiment, one or more spacers 32 may have a different configuration, in which the height and width dimensions of spacers 32 vary compared to the attaching side of main body 12 and gripping member 28, with specific non-limiting examples set forth in greater detail below.

In an embodiment, spacers 32 may have different thicknesses relative to each other. It is contemplated that the device may use a plurality of spacers, some having different thicknesses, to reduce the number of spacers that must be used in a given application. For example, if each spacer 32 is an eighth of an inch thick, and the user wishes to move the stock engagement point out by ⅝", live ⅛" spacers would be used. In an alternative embodiment, for example, a spacer 32 may be a quarter-inch or a half-inch thick, in which case fewer spacers are needed, reducing the amount of time and hassle involved in adjusting the stock engagement point.

In an embodiment, main body 12, gripping member 28, and/or spacers 32 may be magnetized. This improves ease-of-use when a plurality of spacers 32 are needed, as magnetized spacers 32 will hold together, reducing the amount of effort and focus that the user must dedicate to holding the spacers 32 together manually, allowing the user to focus on aligning bores 34, 36 and 38.

The depicted device A of FIG. 2 is generally used by rigidly but removably attaching gripping member 28 to main body 12 with one or more fasteners 30, and using zero, one, or more spacers 32 disposed therebetween to adjust the distance between main body 12 and stock engagement surface 16. Fasteners 30 pass through bore holes 36 and 34 and attach to main body 12 via bore holes 38. Main body 12 is generally removably but fixedly attached to a working surface of a fixture in a generally non-movable fashion by inserting fastener 10 into through bore 14 such that fastener 10 engages an engagement point (e.g., a hole or bore) in the fixture. This causes gripping member 28 to slide towards and engage the workpiece, applying a downward and inward force on the workpiece where stock engagement surface 16 abuts the workpiece, and thereby holding the workpiece in place. This removable but fixed attachment of main body 12 to a working surface of a fixture in a generally non-movable fashion may be done using any technique known in the art, including, but not necessarily limited to, through use of a draft angle formed by a tapered stock engagement surface 16. This is and other techniques for such attachment are described in the disclosure of the '106 Patent, which has been incorporated herein by reference.

Although two bore holes 38 are depicted, more may be used. While additional bore holes 38 increase stability, they also increase set-up time. In another embodiment, a single bore hole 38 may be used, but this is generally not preferred. If rotational forces applied to the workpiece are translated to gripping member 28 when attached to main body 12 by a single fastener 30, gripping member 28 may itself rotate around fastener 30, potentially damaging the device or workpiece.

Figure 3:
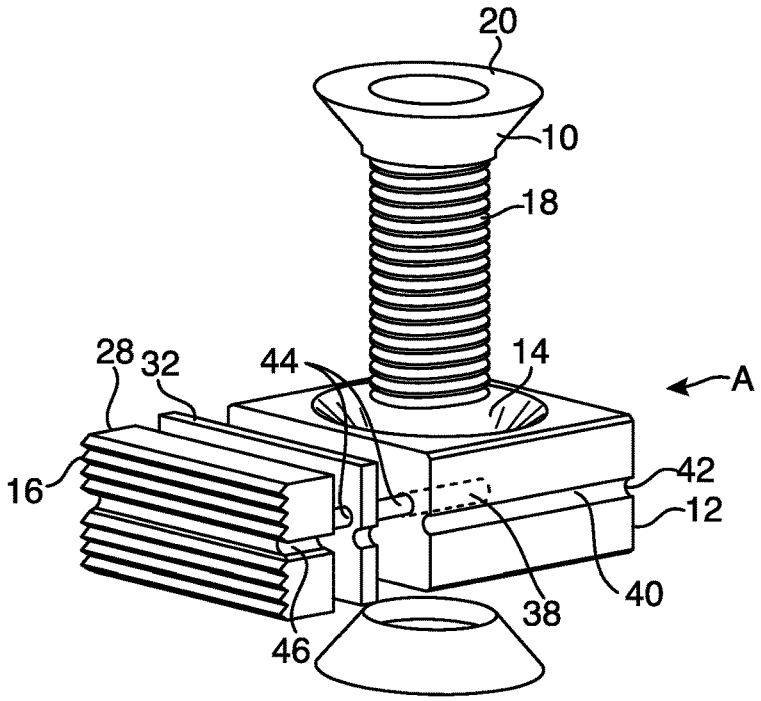
FIG. 3 is a partially exploded view of an alternative embodiment of a gripping device having an adjustable stock engagement point.
Figure 4:
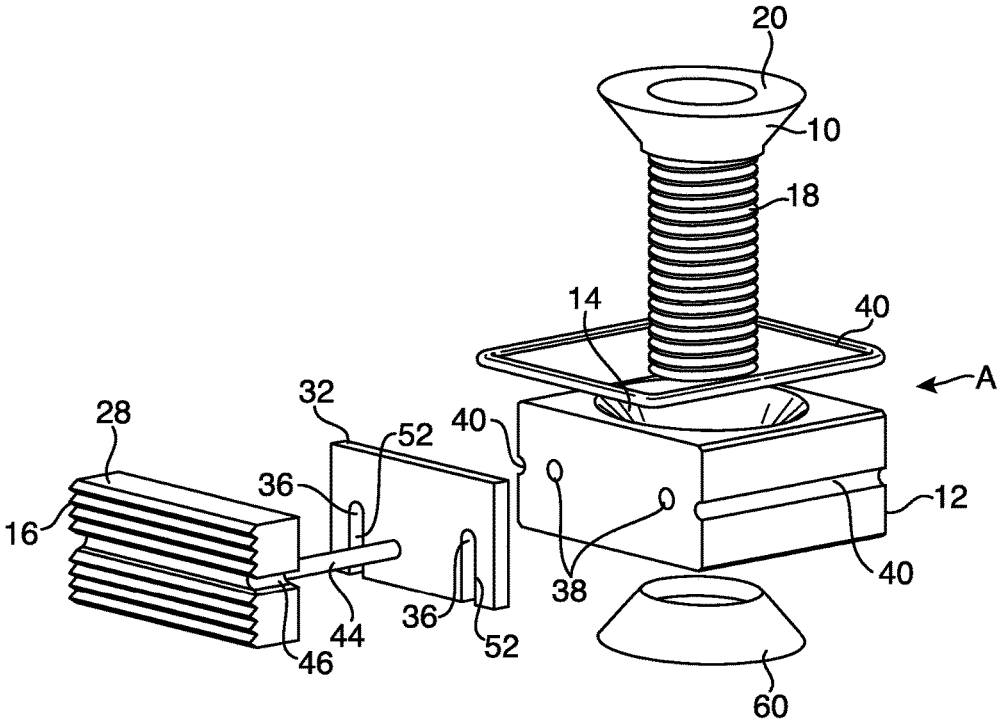
FIG. 4 is a fully exploded view of the gripping device depicted in FIG. 3.

In an alternative embodiment, such as that depicted in FIGS. 3 and 4, gripping member 28 and/or spacers 32 are held in place by one or more attaching members 40. In the depicted embodiment, attaching member 40 is an elastic band, or "O-ring" 40 instead of a mechanical fastener. This reduces overhead by providing a single fastening element which applies the fastening force along gripping member 28 to inhibit slippage.

It is specifically contemplated that attaching member 40 may be an elastic, mechanical, chemical (e.g., adhesive), magnetic, or other type of fastener or fastening means. For example, attaching member 40 may be one or more springs.

It should be further noted that the use of an attaching means to hold gripping member 28 to the main body 12 (and to hold spacer 32 in place) may be optional in an embodiment, as the forces operating on the device A are sometimes sufficient to inhibit slippage or other undesired movement of gripping member 28, and/or spacer 32 relative to each other and/or to main body 12.

In the depicted embodiment of FIGS. 3 and 4, main body 12 comprises one or more bore holes 38. In the depicted embodiment, main body 12 further comprises a recessed channel 42 on one or more lateral sides of main body 12. Generally, such channels will be disposed linearly to form a continuous/contiguous channel at least partially circumscribing main body 12. For purposes of this disclosure, the terms continuous and contiguous when used alone should each be understood to also carry the meaning of the other.

Channel 42 is sized and shaped to fixedly receive O-ring 40. Depicted gripping member 28 also comprises a recess channel 46 sized and shaped to accept and accommodate O-ring 40. Gripping member 28 further comprises one or more fastening pegs 44, generally rigidly and perpendicularly attached to gripping member 28. Bore holes 38 are sized and shaped to accommodate fastening pegs 44. Fastening pegs 44 are disposed on gripping surface 28, and bore holes 38 are disposed on main body 12 such that each fastening peg 44 is generally aligned to and coaxial with a corresponding bore hole 38 when the device is assembled.

Gripping member channel 46 is generally disposed on gripping member 28 such that, when gripping member 28 is attached to main body 12, gripping member channel 46 aligns generally linearly and continuously with main body 12 channel 42. This facilitates the use of O-ring 40 as described elsewhere herein. Channel 46 is generally disposed on at least stock engagement surface 16. Channel 46 and O-ring 40 are generally sized and shaped such that when O-ring 40 is disposed in channel 46, O-ring 40 is sufficiently recessed into gripping member 28 as to not contact the workpiece or otherwise interfere with stock engagement as between the workpiece and stock engagement surface 16. In the depicted embodiment, channel 46 is also on the lateral sides of gripping member 28. This arrangement is preferred, as it inhibits O-ring 40 slippage, and improves linearity with main body 12 channel 42. Also, the interior corners of channels 42 and 46 may be rounded, which may improve O-ring's 40 engagement with gripping surface 28 and/or main body 12, and reduce wear on O-ring 40, extending its useful life.

O-ring 40 generally comprises a continuous band of elastic material, being sized and shaped, and has an effective coefficient of elasticity, to be stretched or expanded to fit around the combination of main body 12, gripping member 28, and one or more spacers 32. O-ring 40 generally has a natural, unexpanded circumference less than that of the channels into which it is disposed. Thus, when released, O-ring 40 constricts to removably but fixedly hold gripping member 28 and spacers 32 to main body 12. When in this configuration, the channels 42 and 46 of main body 12 and gripping member 28 align generally linearly to continuously circumscribe the assembly of main body 12 and gripping member 28, with O-ring 40 disposed in a continuous channel formed by channels 42 and 46. The compressive force of O-ring's 40 tendency to return to its original shape after being deformed (i.e., stretched) around main body 12 and gripping member 28 holds gripping member 28 (and spacers 32) in place. Slippage is inhibited by channels 42 and 46, and the cooperation of fastening pegs 44 with bore holes 38. O-ring 40 is generally made from, or coated or treated with, an oil- and debris-resistant material. The device can operate using a single O-ring 40, reducing the need for additional parts and lowering manufacturing costs.

Spacers 32 may comprise one or more bore holes 36, each of which is disposed on spacer 32 to align to and be coaxial with a corresponding fastening peg 44, and a corresponding bore hole 38 in main body 28. Alternatively, as depicted in FIGS. 3 and 4, bore hole 36 may not be an enclosed circle, but rather open on one side, extending to an outside edge of spacer 32. The resulting structure is essentially a deep but narrow channel 52, having a width generally the same as the diameter of a bore hole 36, extending from the exterior to the interior side of spacer 32. This has advantages over a bore hole 36, in that it allows spacer 32 to be added to, or removed from, the assembly without having to fully disengage fastening pegs 44 from bore holes 38. Instead, gripping member 28 can be slightly disengaged, enough to allow the user to add a spacer by aligning channels 52 with fastening pegs 44, inserting spacer 32 between gripping member 28 and main body 12 (or other spacers 32) until fastening peas 44 engage bore hole 36, and then fully re-engaging gripping member 28 with main body 12 via fastening pegs 44 and bore holes 38. One or more spacers 32 could be removed by reversing the procedure.

Because O-ring 40 generally circumscribes the assembly, the width of spacer 32 may be shorter than that of gripping member 28 or main body 12, thus allowing O-ring 40 to extend past the outside edges of spacer 32 without contacting spacer 32, reducing wear from friction and improving fit. Alternatively, spacer 32 may have one or more channels sized and shaped to accept and accommodate O-ring 40 disposed on spacer 32 such that, when spacer 32 is part of the assembly of gripping member 28 and main body 12, spacer 32 channels are generally linearly aligned and continuous with channels 46 and 42 such that the combination of main body 12, gripping member 28, and spacer(s) 32 result in a generally continuous channel circumscribing the assembly, and sized and shaped to receive O-ring 40.

It should be noted that the number of sides of main body 12 and/or gripping surface 28, which have channels, may vary from embodiment to embodiment, depending, among other things, on the shape and configuration of main body 12 and/or gripping surface 28. In the depicted embodiment, channel 42 is on the three lateral surfaces of main body 12 which do not have bore holes 38. This is because bore holes 38 in the depicted embodiment of FIGS. 3 and 4 are sized and shaped to accommodate pegs 44 on gripping member 28, and O-ring 40 circumscribes the assembly. Because bore holes 38 are covered when the device is assembled, the portion of O-ring 40 which would cross the surface of main body 12 having bore holes 38 is covered by gripping member 28, and thus gripping member 28 has channel 46 for O-ring 40. Because attaching pegs 44 are generally not used in the depicted embodiments of FIGS. 3 and 4 to hold gripping member 28 to main body 12, attaching pegs 44 generally are not threaded in such an embodiment and, accordingly, neither bore holes 38 are threaded.

The embodiment depicted in FIGS. 3 and 4 is generally used similarly to the embodiment of FIG. 2. Gripping member 28 is fixedly but removably attached to main body 12 by placing attaching pegs 44 in corresponding bore holes 38 and disposing zero, one, or more spacers 32 therebetween to adjust the distance between main body 12 and stock engagement surface 16. Channels 42 and 46 are aligned linearly and continuously in the assembly of main body 12, gripping member 28, and zero, one, or more spacers 32. O-ring 40 is deformed (i.e., expanded) to circumscribe the assembly and then disposed in the continuous channel circumscribing the assembly and released to return to its unexpanded circumference. Main body 12 is generally attached to a working surface of a fixture in a generally non-movable fashion by inserting fastener 10 into through bore 14 such that fastener 10 engaged an engagement point (e.g., a hole or bore) in the fixture. This causes gripping member 28 to slide towards and engage the workpiece, applying a downward and inward force on the workpiece where stock engagement surface 16 abuts the workpiece, thereby holding the workpiece in place. As previously described with respect to FIG. 2, this removable but fixed attachment of main body 12 to a working surface of a fixture in a generally non-movable fashion may be done using any technique known in the art, including but not necessarily limited to through use of a draft angle formed by a tapered stock engagement surface 16. This, and other techniques for such attachment, are described in the disclosure of the '106 Patent, which has been incorporated herein by reference.

In the depicted embodiment of FIG. 4, device A further comprises an optional bottom thrust washer 60. Washer 60 may be installed or otherwise disposed under device A during operation, raising main body 12 by an amount effective to cause gripping member 28 to apply downward clamping during use.

Although the depicted gripping member 28 is generally in the configuration of a rectangular prism, other shapes are specifically contemplated. In particular, the configuration and contour of the stock engagement surface 16 may be adjusted or customized for particular applications. By way of example and not limitation, where the workpiece is rounded, the profile of the stock engagement surface 16 may be an arc, to match and fit the workpiece. Similarly, the stock engagement surface 16 may actually comprise, in an embodiment, a plurality of surfaces to accommodate a workpiece, such as two adjoining surfaces to accommodate a triangular workpiece.

In an embodiment, main body 12 is comprised of steel, carburized-hardened, with a black oxide finish. In an embodiment, stock engagement surface 16 comprises a steel, carburized-hardened block, oxide finish. In an embodiment, stock engagement surface 16 comprises an acetal resin, carbide coating, and/or diamond coating. In an embodiment, washer 60 comprises a steel, carburized-hardened block oxide finish. In an embodiment, one or more fasteners comprises steel and/or a black oxide finish. In an embodiment, at least some steel is 1018 carbon steel. In another embodiment, at least some steel is 1144 carbon steel. Other finishes and materials recognized by one of ordinary skill in the art may be utilized in other embodiments.

While the invention has been described with reference to a preferred embodiment thereof, it is to be understood that modifications or variations may be easily made without departing from the scope of the present invention which is defined by the appended claims.

The invention claimed is:

1. A clamp comprising:

a main body generally in the configuration of a rectangular prism and comprising:

a top and an opposing bottom with a main body bore extending there through and sized and shaped to accept a first fastener;

an attachment side adjacent and generally perpendicular to said top and said bottom side having disposed thereon a number of bore holes, and a back side opposing said attachment side, said back side having a recessed channel sized and shaped to accommodate an O-ring;

a first lateral side extending between said attachment side and said back side and an opposing second lateral side, said first lateral side and said second lateral side each having a recessed channel sized and shaped to accommodate said O-ring and disposed on said first lateral side and said second lateral side continuously with said back side channel;

a gripping member generally in the configuration of a rectangular prism and comprising:

an exterior stock engagement surface having a recessed channel sized and shaped to accommodate said O-ring;

an interior surface opposing said exterior stock engagement surface and having disposed generally perpendicularly thereon a number of attachment pegs equal to said number of bore holes in said attachment side, each one of said attachment pegs being disposed on said gripping member such that said each one of said attachment pegs is generally coaxial with a corresponding bore hole in said attachment side, and each one of said attachment pegs is sized and shaped to be received by said corresponding bore hole;

a plurality of opposing lateral sides extending between said exterior stock engagement surface and said interior surface, each of said opposing lateral sides having a recessed channel sized and shaped to accommodate said O-ring and disposed continuously with said stock engagement surface channel;

at least one spacer generally in the configuration of a rectangular prism and having disposed there through a number of spacer through bores equal to said number of bore holes in said attachment side, each one of said spacer through bores being disposed through said at least one spacer such that said each one of said spacer through bores is generally coaxial with a corresponding bore hole in said attachment side, and each one of said spacer through bores being sized and shaped to accept a corresponding attachment peg; and wherein when said gripping member is assembled with said main body, said channels form a single contiguous channel sized and shaped to receive said O-ring and circumscribing said assembly.

2. The clamp as claimed in claim 1, wherein the height and width of said attachment side is generally equal to the height and width of said gripping member.

3. The clamp as claimed in claim 1, wherein the height and width of said at least one spacer is generally equal to the height and width of said gripping member.

4. The clamp as claimed in claim 1, wherein said number of bore holes is two.

5. The clamp as claimed in claim 1, wherein said at least one spacer comprises a plurality of spacers.

6. The clamp as claimed in claim 1, further comprising said O-ring, wherein said O-ring comprises an elastic material and has an unexpanded circumference less than the circumference of said single contiguous channel.

7. The clamp as claimed in claim 6, wherein said O-ring is generally in the shape of a quadrilateral.

8. The clamp as claimed in claim 7, wherein said O-ring is generally in the shape of a square.

* * * * *